US006538633B1

(12) United States Patent
Ito

(10) Patent No.: US 6,538,633 B1
(45) Date of Patent: Mar. 25, 2003

(54) LIQUID CRYSTAL DISPLAY APPARATUS AND METHOD FOR CONTROLLING THE SAME

(75) Inventor: Takae Ito, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 61 days.

(21) Appl. No.: 09/651,931

(22) Filed: Aug. 31, 2000

(30) Foreign Application Priority Data

Oct. 12, 1999 (JP) ..... 11-289938

(51) Int. Cl.[7] ..... G09G 3/36

(52) U.S. Cl. ..... 345/99; 345/211; 345/212; 345/213

(58) Field of Search ..... 345/99, 211, 212, 345/213, 87

(56) References Cited

U.S. PATENT DOCUMENTS 5,406,308 A * 4/1995 Shiki ..... 345/127
5,731,798 A * 3/1998 Shin ..... 345/99
5,781,185 A * 7/1998 Shin ..... 345/213
5,940,061 A * 8/1999 Sato ..... 345/99

FOREIGN PATENT DOCUMENTS

| | | |
|---|---|---|
| JP | 5100632 | 4/1993 |
| JP | 8181956 | 7/1996 |
| JP | 10161598 | 6/1998 |

* cited by examiner

*Primary Examiner*—Richard Hjerpe
*Assistant Examiner*—Kimnhung Nguyen
(74) *Attorney, Agent, or Firm*—Greer, Burns & Crain, Ltd.

(57) ABSTRACT

A liquid crystal display apparatus displaying an image on a liquid crystal panel thereof includes a driving driver driving the liquid crystal panel, a control signal forming circuit generating two clock signals CK1 and CK2 by dividing a clock signal CK used for transferring image display data to the liquid crystal panel, transmission lines transmitting the clock signals CK1 and CK2, and an exclusive OR circuit restoring the clock signal CK based on the two clock signals CK1 and CK2 and supplying the restored clock signal CK to the driving driver.

7 Claims, 7 Drawing Sheets

T1 T2 T3 T4 T5 T6 T7

CK
H
L
T
T

IN-DATA
D1
D2
D3
D4
D5
D6
D7
D8

DATA
D1
D2
D3
D4
D5
D6
D7
D8

CK1
H
L

CK2
H
L

CK3
H
L

OUT-DATA
D1
D2
D3
D4
D5
D6
D7
D8

LIQUID CRYSTAL DISPLAY APPARATUS AND METHOD FOR CONTROLLING THE SAME

BACKGROUND OF THE INVENTION

1. Field of the Invention

The present invention generally relates to a liquid crystal display, and more particularly to control the same.

2. Description of the Related Art

FIG. 1 is a diagram showing a conventional liquid crystal display apparatus.

As shown in this diagram, the conventional liquid crystal display apparatus includes a liquid crystal panel 1, a gate driver 3, a driving driver 5, a control signal generating circuit 9, and a plurality of transmission lines 11.

The liquid crystal panel 1 is used to display an image. The gate driver 3 is coupled to the control signal generating circuit 9, which selectively drives gate lines GL arranged in the liquid crystal panel 1.

The driving driver 5 is used to drive source lines SL, which are arranged in the liquid crystal panel 1, so as to cause image display data DATA to be displayed in response to a clock signal CK and a latch pulse signal LP, which are supplied from the transmission lines 11.

The control signal generating circuit 9, which is formed on a substrate 7, receives the clock signal CK, a horizontal synchronizing signal Hsync, a vertical synchronizing signal Vsync and image display data IN-DATA, and outputs the received clock signal CK, the latch pulse signal LP and the image display data DATA.

The transmission lines 11, which are coupled to the control signal generating circuit 9 and are provided on a wiring plate 16, serve to transfer the signal CK, the latch pulse LP and the image display data DATA to the driving driver 5. In this example, the driving driver 5 is connected to three transmission lines 11 provided on the wiring plate 16.

In recent years, the liquid crystal display apparatus has been produced with high density and the liquid crystal panel 1 has been designed to be able to display a large amount of image. In order to support this situation, it is required to transfer the image display data to the liquid crystal panel 1 at a higher rate. For example, the liquid crystal panel 1 with an SXGA size (1280×1024 dots) uses the clock signal CK with an average frequency of 54 MHz.

As the liquid crystal panel 1 has a large scale, the transmission lines 11, which are coupled to the driving driver 5 used to drive the liquid crystal panel 1, become longer.

As the transmission lines 11 become longer, it is more difficult to sufficiently drive stray capacitance caused by capacitance/resistance components of the transmission lines 11. As a result, conventionally, the transmission lines 11 need to be provided with buffers so as to ensure high-speed driving.

Further, the higher the frequency of the clock signal CK becomes, the more electromagnetic interference caused by radiation of unwanted electronic waves are increased.

SUMMARY OF THE INVENTION

It is a general object of the present invention to provide a liquid crystal panel and a method of controlling the liquid crystal panel, in which the above disadvantages can be overcome.

The above object and other objects of the present invention are achieved by a circuit for driving a liquid crystal panel driving comprising:

a restoring unit restoring a first clock signal, in response to which a liquid crystal panel is to be driven, based on second clock signals each having a frequency lower than that of said first clock signal; and a driving unit connected to said restoring unit so as to drive said liquid crystal panel in response to said first clock signal restored by said restoring unit.

A better understanding of the features and advantages of the present invention will be obtained by reference to the following detailed description of the invention and accompanying drawings which set forth an illustrative embodiment in which the principles of the invention are utilized.

DETAILED DESCRIPTION OF THE PREFERRED EMBODIMENTS

Figure 1:
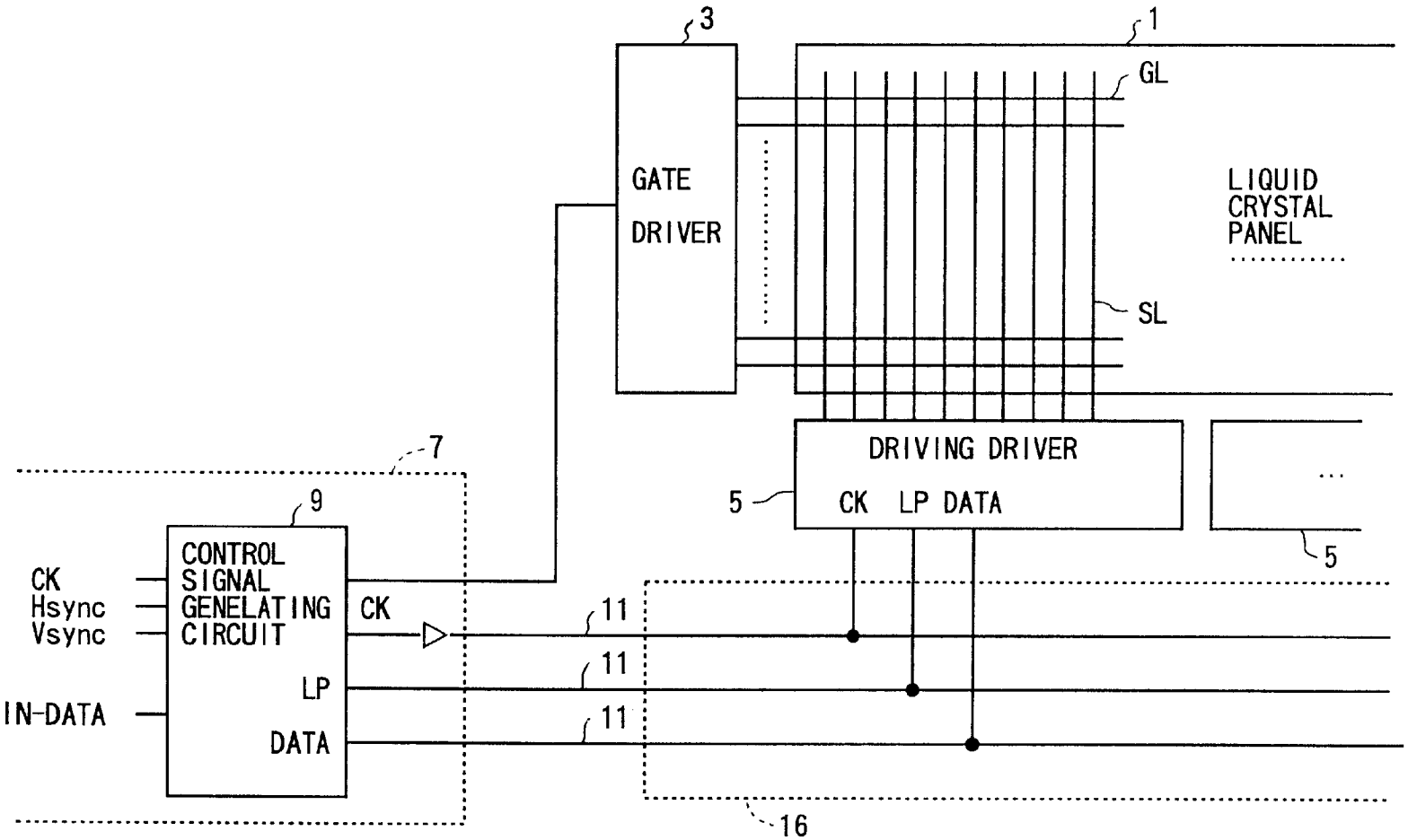
FIG. 1 PRIOR ART
FIG. 1 is a diagram showing a conventional liquid crystal display apparatus.

With reference to the drawings, preferred embodiments of the present invention will be described below. In addition, the same reference numerals and characters are used to denote the same parts or equivalents.

First, a description will be given of a liquid crystal display apparatus 20 according to a first embodiment of the present invention, by referring to FIG. 2.

Figure 2:
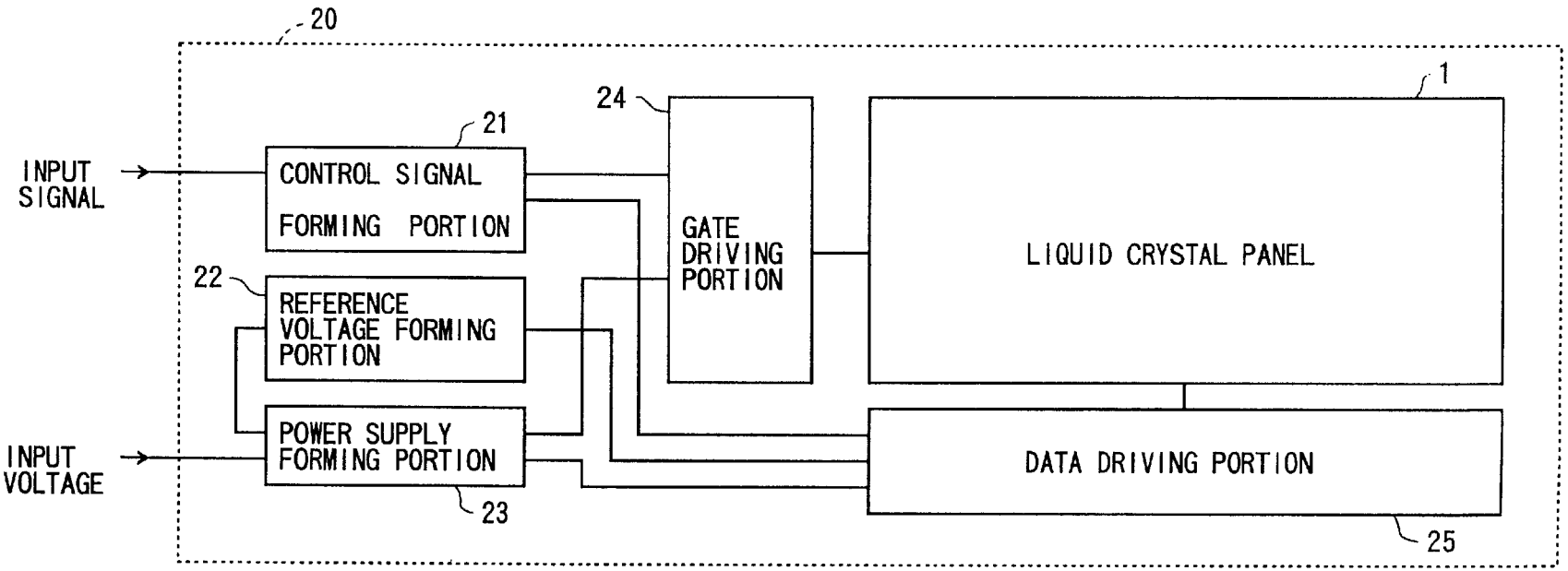
FIG. 2 is a block diagram showing a configuration of a liquid crystal display apparatus of a first embodiment in accordance with the present invention.

FIG. 2 is a block diagram showing a configuration of the liquid crystal display apparatus 20 of the first embodiment. As shown in this diagram, the liquid crystal display apparatus 20 includes the liquid crystal panel 1, a gate driving portion 24, a data driving portion 25, a control signal generating portion 21, a reference voltage generating portion 22, and a power supply generating portion 23.

The liquid crystal panel 1 is used to display an image based on image display data supplied from the data driving portion 25. The gate driving portion 24 is used to drive the gate lines GL wired in the liquid crystal panel 1.

The data driving portion 25 is used to supply the image display data to the liquid crystal panel 1. The control signal generating portion 21 is connected to both the gate driving portion 24 and the data driving portion 25 and is supplied with an input signal inputted externally.

The power supply generating portion 23 is supplied with an input voltage supplied externally so as to generate an internal power supply voltage based on the input voltage and supply the internal power supply voltage to the reference voltage generating portion 22, the gate driving portion 24 and the data driving portion 25.

The reference voltage generating portion 22 generates a reference voltage based on the internal power supply voltage supplied from the power supply generating portion 23, and supplies the reference voltage to the data driving portion 25.

The liquid crystal panel 1 may be regarded as a well-known liquid crystal panel, where the gate lines GL and the source lines SL are intersected and a plurality of thin-film transistors (TFT) serving as switching elements are provided near intersected places thereof.

Figure 3:
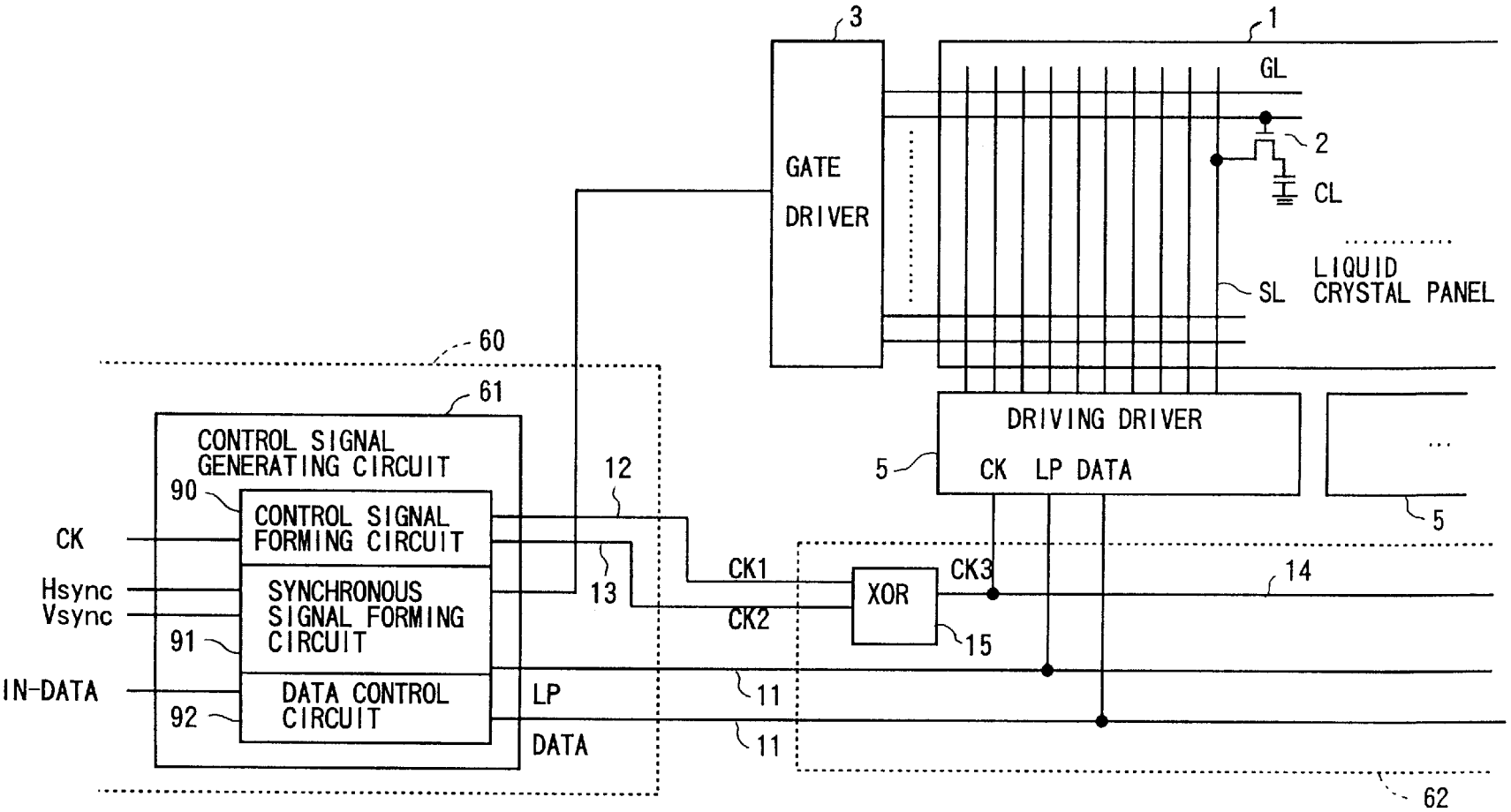
FIG. 3 is a diagram showing a control signal generating portion and a data driving portion of the liquid crystal display apparatus in FIG. 2 of the first embodiment in accordance with the present invention.

FIG. 3 is a diagram showing configurations of the control signal generating portion 21 and the data driving portion 25 of the liquid crystal display apparatus 20 in FIG. 2.

In FIG. 3, a control signal generating circuit 61 formed on a substrate 60 is included in the control signal forming portion 21 of FIG. 2, the gate driver 3 is included in the gate driving portion 24 of FIG. 2, and a wiring plate 62 and the driving driver 5 are included in the data driving portion 25 of FIG. 2.

In addition, in this embodiment, the driving driver 5 serves as a driving unit, a control signal forming circuit 90 serves as a frequency dividing unit, the transmission lines 12 and 13 serve as signal transmitting means, and an exclusive OR circuit 15 serves as a signal restoring unit.

The control signal generating circuit 61 formed on the substrate and the wiring plate 62 for supplying the signals to the driving driver 5 are different from those of FIG. 1 in structure.

Specifically, the control signal generating circuit 61 includes the control signal forming circuit 90, a synchronous signal forming circuit 91, and a data control circuit 92.

The control signal forming circuit 90 is supplied with a clock signal CK for transferring the image display data so as to divide the clock signal CK into two clock signals CK1 and CK2. The synchronous signal forming circuit 91 is supplied with both a horizontal synchronizing signal Hsync and a vertical synchronizing signal Vsync or with a data enable signal or the like so as to form synchronizing signals such as a latch pulse LP and the like. The data control circuit 92 is supplied with image display data IN-DATA so as to form the image display data DATA.

Further, as shown in FIG. 3, the control signal forming circuit 90 is coupled to both a transmission line 12 for transmitting the clock signal CK1 and a transmission line 13 for transmitting the clock signal CK2. The synchronous signal forming circuit 91 is coupled to one of the transmission lines 11 for transmitting the latch pulse LP. The data control circuit 92 is coupled to another one of the transmission lines 11 for transmitting the image display data DATA. The above-mentioned four transmission lines 11, 12 and 13 are provided on the wiring plate 62 so as to send the signals CK1, CK2, LP and the image display DATA and the like to the driving driver 5.

The wiring plate 62 is provided with an exclusive OR circuit 15. The transmission lines 12 and 13 are coupled to one end of the exclusive OR circuit 15, and a transmission line 14 is coupled to the other end thereof. The exclusive OR circuit 15 serves to combine the signals CK1 and CK2 transmitted over the transmission lines 12 and 13 into a signal CK3 and then transmit the combined signal CK3 to the driving driver 5 over the transmission line 14. The transmission line 14 is also provided on the wiring plate 62.

The driving driver 5, which is connected to the two transmission lines 11 and the transmission line 14, is supplied with the clock signal CK3 over the transmission line 14 and with the latch pulse LP and the image display data DATA over the respective transmission lines 11.

The above-mentioned clock signal CK3 is a clock signal having the same phase and period as those of the clock signal CK to be described later. Accordingly, in the liquid crystal display apparatus 20 of the first embodiment, the clock signal CK is once divided into the two phase-different clock signals CK1 and CK2 at the control signal forming circuit 90, and then the clock signals CK1 and CK2 are transmitted over the transmission lines 12 and 13 to the exclusive OR circuit 15. And the exclusive OR circuit 15 combines the two clock signals CK1 and CK2 into the clock signal CK3 (clock signal CK) and then sends the clock signal CK3 to the driving driver 5.

As a result, since the frequencies of the clock signals CK1 and CK2 are lower than that of the clock signal CK, the transmission lines 12 and 13, over which the clock signals CK1 and CK2 are transmitted, can be driven easily. Further, the image display data DATA can be transferred to the liquid crystal panel 1 at high speed over the transmission lines 11 without increasing the number thereof. In addition, the image display data, which has transferred to the liquid crystal panel 1, is supplied to a liquid crystal capacitance CL via a thin-film transistor 2, which is switched ON by selectively actuating two intersected ones of the source lines SL and the gate lines GL.

Further, since the frequencies of the clock signals CK1 and CK2 are each lower than that of the clock signal CK, the strength of the radiation of the useless electric waves can be suppressed.

Next, a detailed description will be given, with reference to FIG. 4, of the control signal forming circuit 90 and the data control circuit 92 of FIG. 3.

Figure 4:
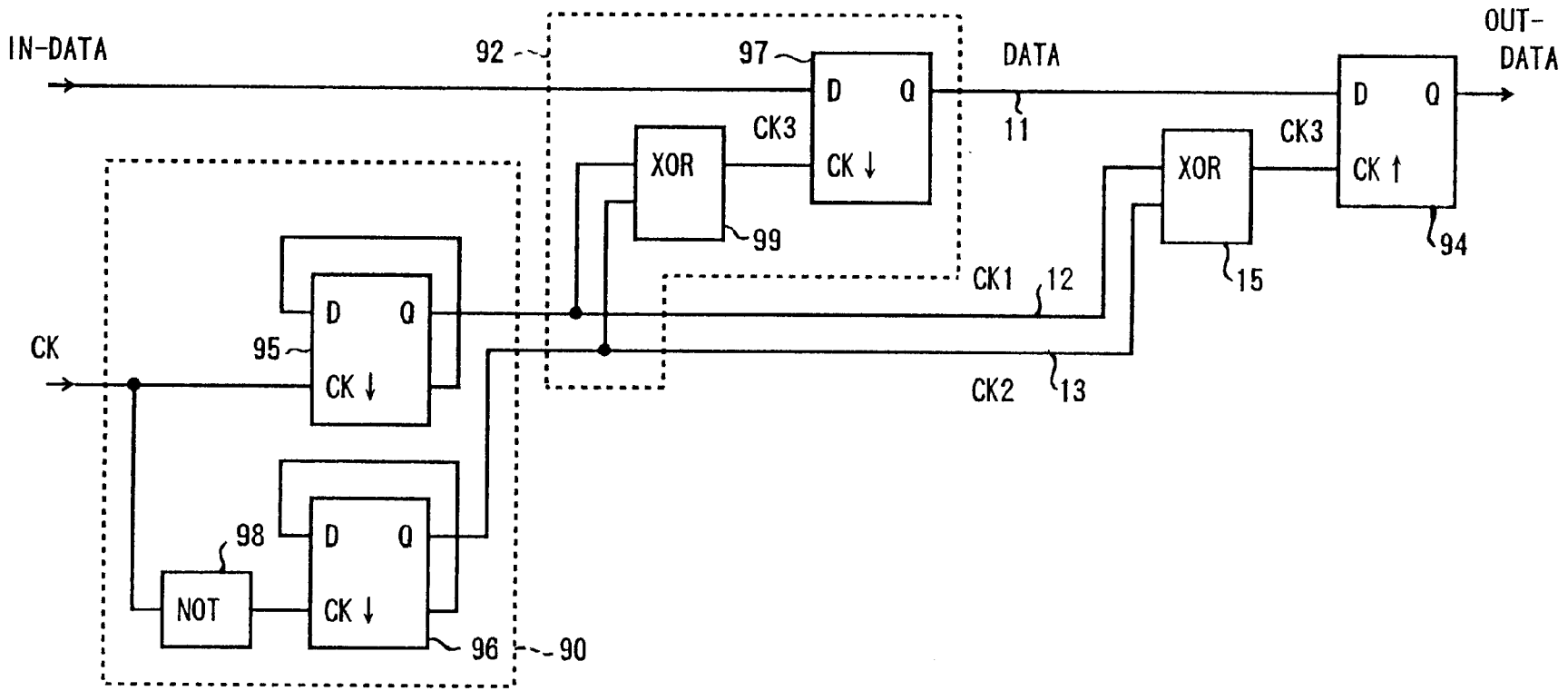
FIG. 4 is a diagram showing a control signal generating circuit and a data control circuit in FIG. 3 of the first embodiment in accordance with the present invention.

As shown in FIG. 4, the control signal forming circuit 90 includes a D flip-flop 95, a D flip-flop 96 and a NOT circuit 98.

The D flip-flop 95 is used to receive the clock signal CK so as to generate the clock signal CK1 and output the same to the transmission line 12. The NOT circuit 98 is used to receive the clock signal CK so as to invert the same. The D flip-flop 96 is used to receive the inverted clock signal CK so as to generate the clock signal CK2 and output the same to the transmission line 13.

The data control circuit 92 includes an exclusive OR circuit 99 and a D flip-flop 97.

The exclusive OR circuit 99 is connected to the two transmission lines 12 and 13 so as to receive the two clock signals CK1 and CK2 and generate the clock signal CK3. The D flip-flop 97 is used to receive the image display data IN-DATA inputted externally and the clock signal CK3 generated at the exclusive OR circuit 99, where the image display data DATA is generated by latching the image display data IN-DATA in response to the clock signal CK3 and then is outputted to the transmission line 11.

In addition, as shown in FIG. 4, a D flip-flop 94, which may be included in a shift register of the driving driver 5 of FIG. 3, is used to latch the image display data DATA in response to the clock signal CK3 generated at the exclusive OR circuit 15 so as to generate image display data OUT-DATA.

A description will be given below of actions of the circuits shown in FIG. 4, by referring to FIGS. 5A through 5G.

Figures 5A, 5B, 5C, 5D, 5E, 5F, 5G:
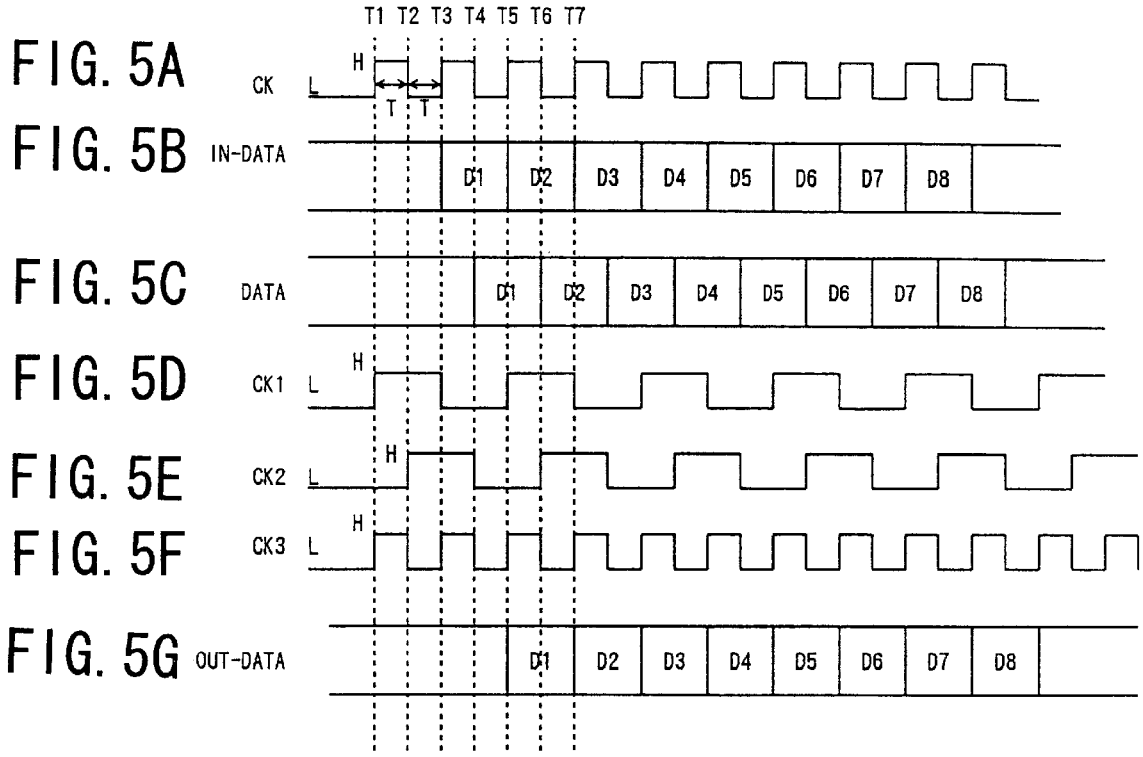
FIGS. 5A through 5G are time charts showing actions of circuits in FIG. 4.

FIGS. 5A through 5G are time charts illustrating actions of the circuits shown in FIG. 4. As shown in FIG. 5A, the clock signal CK may be regarded as a binary signal, which has a period of 2T, a half period T representing a high level, the other half period T representing a low level. The clock signal CK is used to regulate a transfer rate of the image display data. For example, a half period T from T1 to T2 denotes the high level and a half period T from T2 to T3 denotes the low level.

The clock signal CK is divided at the D flip-flop 95 into two parts including the clock signal CK1. As shown in FIG. 5D, the clock signal CK1 has a period of 4T, a half period 2T of T1 through T3 denoting a high level, the other half period 2T of T3 through T5 denoting a low level.

The clock signal CK is, on the other hand, inverted at the NOT circuit 98 and then divided at the D flip-flop 96 into two parts including the clock signal CK2. As shown in FIG. 5E, the clock signal CK2 has a period of 4T, a half period 2T of T2 through T4 denoting a high level, the other half period 2T of T4 through T6 denoting a low level. In addition, the clock signal CK2 has its phase delayed ¼ of the period 4T with respect to the clock signal CK1.

The exclusive OR circuits 15 and 99 logically operate the two clock signals CK1 and CK2 so as to generate the clock signal CK3 as shown in FIG. 5F, respectively. Since the clock signal CK3 shown by FIG. 5F has the same phase and period as the clock signal CK shown by FIG. 5A, the clock signal CK is thus restored at the exclusive OR circuits 15 and 99.

As shown in FIGS. 5B and 5C, the image display data DATA generated at the D flip-flop 97 has its phase delayed ½ period thereof (T) with respect to the image display data IN-DATA. As shown in FIGS. 5C and 5G, the image display data OUT-DATA generated at the D flip-flop 94 has its phase delayed ½ period thereof (T) with respect to the image display data DATA. As a result, the image display data OUT-DATA, the phase of which is delayed one period (2T) with respect to that of the image display data IN-DATA, is generated at the D flip-flop 94.

As previously described, in the liquid crystal display apparatus 20 of the first embodiment, the clock signal CK, which is used to transfer the image display data DATA, is divided into the two clock signals CK1 and CK2 at the control signal forming circuit 90. The two clock signals CK1 and CK2, which are shifted ¼ period with each other, are transmitted to the wiring plate 62 over the respective transmission lines 12 and 13. Thus, the frequencies of the clock signals CK1 and CK2, which are transmitted over the transmission lines 12 and 13, are each lower than that of the clock signal CK.

As a result, the transmission lines 12 and 13 become easy to be driven.

Further, the two clock signals CK1 and CK2 are transmitted over the transmission lines 12 and 13 to the exclusive OR circuit 15, where the clock signal CK is restored by combining the two clock signals CK1 and CK2 into the clock signal CK3. Then, the restored clock signal CK (the clock signal CK3) is sent to the driving driver 5. Therefore, the image display data DATA can be transferred to the liquid crystal panel 1 at high speed without increasing the number of the transmission lines 11.

Furthermore, according to the liquid crystal display apparatus 20 of the first embodiment, since the frequencies of the clock signals CK1 and CK2, which are transmitted over the transmission lines 12 and 13, are each lower than that of the clock signal CK, the strength of the radiation of the useless electric waves can be suppressed and electric wave standards can be easily met.

Next, a description will be given of a liquid crystal display apparatus according to a second embodiment of the present invention, by referring to FIG. 6 and FIG. 7.

Figure 6:
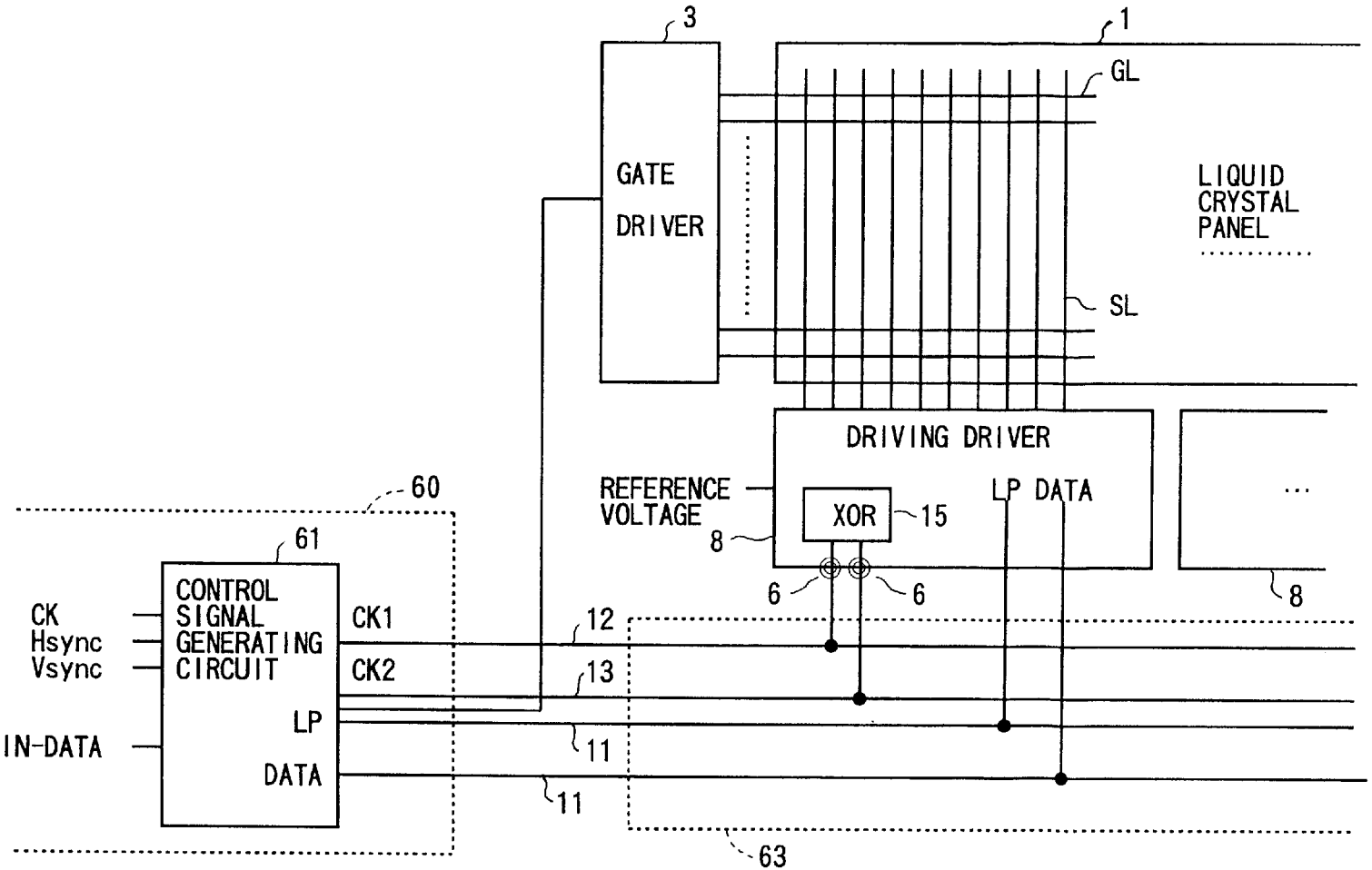
FIG. 6 is a diagram showing a control signal generating portion and a data driving portion of a liquid crystal display apparatus of a second embodiment in accordance with the present invention.

FIG. 6 is a diagram showing configurations of a control signal forming portion and a data driving portion of the liquid crystal display apparatus of the second embodiment.

Unlike the liquid crystal display apparatus 20 of the first embodiment, where the wiring plate 62 is provided with the exclusive OR circuit 15 to which the transmission lines 12 and 13 are each connected and with the transmission line 14 over which the clock signal CK3 generated by the exclusive OR circuit 15 is transferred, in the liquid crystal display apparatus of the second embodiment, the exclusive OR circuit 15 is built in a driving driver 8 instead of being provided on the wiring plate 62, and the transmission lines 11, 12 and 13 are wired on a wiring plate 63 on which the transmission line 14 does not exist.

In such a configuration of the second embodiment, the driving driver 8 is provided with two terminals 6 serving to receive the respective clock signals CK1 and CK2.

Figure 7:
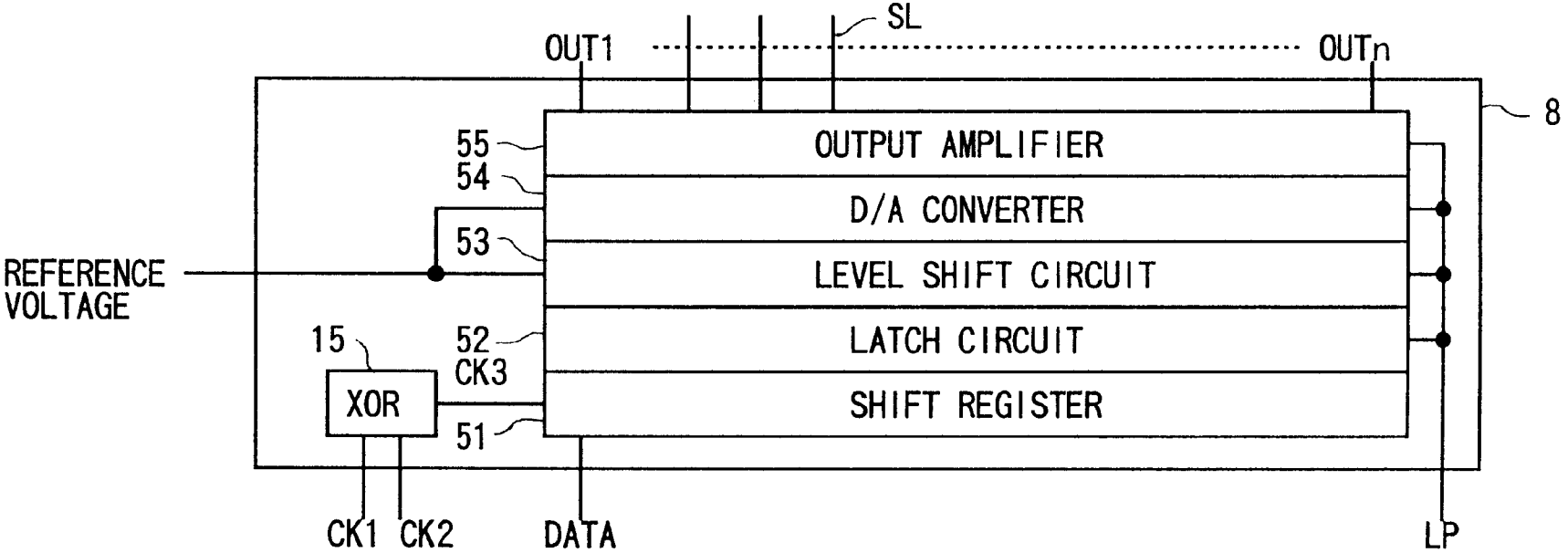
FIG. 7 is a diagram showing a configuration of a driving driver in FIG. 6.

FIG. 7 is a diagram showing a configuration of the driving driver 8 of FIG. 6. In addition, a shift register 51 is included in the D flip-flop 94 of FIG. 4.

As shown in FIG. 7, the driving driver 8 includes the shift register 51, a latch circuit 52, a level shift circuit 53, a D/A converter 54 and an output amplifier 55.

Specifically, the shift register 51 is used to hold the image display data DATA supplied over the transmission line 11 and to output the image display data OUT-DATA in order in response to the clock signal CK3 generated at the built-in exclusive OR circuit 15.

The latch circuit 52 is used to latch the imaging OUT-DATA outputted from the shift register 51 in response to the latch pulse LP supplied over the transmission line 11.

The level shift circuit 53 is used to receive the image display data OUT-DATA from the latch circuit 52 synchronously with the latch pulse LP supplied over the transmission line 11 and to convert a voltage level of the image display data OUT-DATA based on the reference voltage supplied externally.

The D/A converter 54 is used to receive the level-converted image display data OUT-DATA from the level shift circuit 53 synchronously with the latch pulse LP supplied over the transmission line 11 and to convert the digital image display data OUT-DATA into an analog image display data OUT-DATA.

The output amplifier 55 is used to receive the analog image display data OUT-DATA from the D/A converter 54 synchronously with the latch pulse LP supplied over the transmission line 11, and to amplify the received analog image display data OUT-DATA so as to output signals OUT1 through OUTn to the source lines SL.

According to such a configuration, the liquid crystal display apparatus of the second embodiment can realize the same effects as those of the first embodiment.

Further, since the exclusive OR circuit 15 is built in the driving driver 8, the transmission lines 12 and 13, over which the frequency-lowered clock signals CK1 and CK2 are transferred, can be extended on the wiring plate 63. As a result, the freedom to layout the transmission lines 12 and 13 can be improved.

Furthermore, according to the liquid crystal display apparatus of the second embodiment, the clock signals CK1 and CK2, which become easy to transfer, can be sent to desirable positions of the liquid crystal display apparatus.

In addition, in a case where the thin-film transistor of the liquid crystal panel 1 is formed by using a polysilicon material, the gate driver 3, the driving drivers 5 and 8, and the circuits such as the exclusive OR circuit 15 and the like can be formed on the same substrate on which the liquid crystal panel 1 is formed, by a panel-forming process. In addition, it is also possible to form the control signal generating circuit 61 on the same substrate by the panel-forming process.

The above description is provided in order to enable any person skilled in the art to make and use the invention and sets forth the best mode contemplated by the inventors for carrying out their invention.

The present application is based on Japanese priority application No. 11-289938 filed on Oct. 12, 1999, the entire contents of which are hereby incorporated by reference.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A circuit for driving a liquid crystal panel comprising:

a restoring unit restoring a first clock signal, in response to which a liquid crystal panel is to be driven, by synthesizing second clock signals by applying a logical operation, each having a frequency lower than that of said first clock signal; and a driving unit connected to said restoring unit so as to drive said liquid crystal panel in response to said first clock signal restored by said restoring unit.

2. A liquid crystal display apparatus comprising:

a liquid crystal panel;

a driving unit driving said liquid crystal panel;

a frequency dividing unit frequency-dividing a clock signal, which is used for transferring image display data to said liquid crystal panel, so as to generate frequency-divided signals;

a signal transmitting unit connected to said frequency dividing unit so as to transmit said frequency-divided signals; and a signal restoring unit connected to said signal transmitting unit so as to restore said clock signal by synthesizing said frequency-divided signals by applying a logical operation, and supply said restored clock signal to said driving unit.

3. The liquid crystal display apparatus as claimed in claim 2, wherein:

said frequency dividing unit divides said clock signal into a number n of frequency-divided signals which are different from each other in phase;

said signal transmitting unit transmits said n frequency-divided signals; and said signal restoring unit restores said clock signal by synthesizing said n frequency-divided signals by applying a logical operation.

4. The liquid crystal display apparatus as claimed in claim 2, further comprising a second signal transmitting unit connected to said signal restoring unit so as to transmit said restored clock signal, wherein said driving unit is connected to said second signal transmitting unit.

5. The liquid crystal display apparatus as claimed in claim 2, wherein said signal restoring unit is provided in said driving unit.

6. A method for controlling a liquid crystal display apparatus displaying an image on a liquid crystal panel thereof, comprising the steps of:

(a) frequency-dividing a clock signal, which is used for transferring image display data to said liquid crystal panel, so as to generate frequency-divided signals;

(b) transmitting said frequency-divided signals;

(c) restoring said clock signal by synthesizing said frequency-divided signals by applying a logical operation; and (d) driving said liquid crystal panel based on said restored clock signal.

7. The method as claimed in claim 6, wherein said step (a) employs a frequency-dividing unit dividing said clock signal for transferring the image display data to said liquid crystal panel.

* * * * *